US010195573B2

(12) United States Patent
Hoefken

(10) Patent No.: US 10,195,573 B2
(45) Date of Patent: Feb. 5, 2019

(54) STIRRING ELEMENT HAVING SEGMENTED CONFIGURATION, FOR CIRCULATING WASTEWATER IN BASIN, AND APPARATUS

(71) Applicant: INVENT UMWELT-UND VERFAHRENSTECHNIK AG, Erlangen (DE)

(72) Inventor: Marcus Hoefken, Erlangen (DE)

(73) Assignee: INVENT UMWELT-UND VERFAIIRENSTECHNIK AG, Erlangen (DE)

( * ) Notice: Subject to any disclaimer, the term of this patent is extended or adjusted under 35 U.S.C. 154(b) by 195 days.

(21) Appl. No.: 15/100,038

(22) PCT Filed: Oct. 27, 2014

(86) PCT No.: PCT/EP2014/072936
§ 371 (c)(1),
(2) Date: May 27, 2016

(87) PCT Pub. No.: WO2015/086211
PCT Pub. Date: Jun. 18, 2015

(65) Prior Publication Data

US 2017/0001156 A1 Jan. 5, 2017

(30) Foreign Application Priority Data

Dec. 11, 2013 (DE) ..... 10 2013 225 662

(51) Int. Cl.
*B01F 7/00* (2006.01)
*B21D 53/26* (2006.01)
*B01F 15/00* (2006.01)

(52) U.S. Cl.
CPC ..... *B01F 7/00725* (2013.01); *B01F 7/0015* (2013.01); *B01F 7/00541* (2013.01);
(Continued)

(58) Field of Classification Search
CPC ..... B01F 7/0055; B01F 7/00541; B01F 15/00922; B01F 7/00033; B01F 7/0015;
(Continued)

(56) References Cited

U.S. PATENT DOCUMENTS 888,199 A * 5/1908 Stafford ..... B01F 7/001 366/67
1,687,660 A * 10/1928 Cummer ..... E01C 19/104 366/66

(Continued)

FOREIGN PATENT DOCUMENTS

DE 3519520 A1 * 12/1986 ..... B01F 3/04539
DE 3603466 A1 * 8/1987 ..... B01F 3/04539

(Continued)

OTHER PUBLICATIONS

PCT/ISA/210, "International Search Report for International Application No. PCT/EP2014/072936", dated Jan. 27, 2015.

(Continued)

*Primary Examiner* — Charles Cooley
(74) *Attorney, Agent, or Firm* — Manabu Kanesaka

(57) ABSTRACT

A device for circulating wastewater is received in a tank, in which a conical or hyperboloid-like stirring body is mounted on a vertical stirring shaft, wherein the stirring body is composed from a plurality of segments produced from metal along radially extending joining zones.

16 Claims, 5 Drawing Sheets

(52) U.S. Cl.
CPC ..... *B01F 15/00922* (2013.01); *B21D 53/267* (2013.01); *B01F 2215/0052* (2013.01)

(58) Field of Classification Search
CPC ..... B01F 2215/0052; B01F 7/00725; B21D 53/267
USPC ..... 416/231 R, 231 A; 366/331
See application file for complete search history.

(56) References Cited

U.S. PATENT DOCUMENTS 1,712,549 A * 5/1929 Castellano ..... E01C 19/185 222/238
1,741,013 A * 12/1929 Cummer ..... E01C 19/104 366/66
1,917,867 A * 7/1933 Barker ..... D06F 13/00 366/276
2,045,919 A * 6/1936 Parraga ..... B01D 11/0457 366/305
2,123,600 A * 7/1938 Galante ..... B01F 7/165 366/247
2,563,937 A * 8/1951 Keight ..... B01F 7/00158 366/181.4
2,577,802 A * 12/1951 Payne ..... B03D 1/16 209/169
2,636,720 A * 4/1953 Forrest ..... B01F 7/001 366/343
2,869,840 A * 1/1959 Schmidt ..... B01F 7/0025 366/196
4,304,494 A * 12/1981 Lutz ..... E01C 19/104 366/327.1
5,152,606 A * 10/1992 Borraccia ..... B01F 7/001 366/270
5,261,745 A * 11/1993 Watkins ..... B01F 7/285 366/246
5,385,448 A * 1/1995 Merkt ..... B01F 7/001 366/330.5
5,524,982 A * 6/1996 Kruse ..... B01F 7/001 366/288
7,784,769 B2 * 8/2010 Hoefken ..... B01F 3/04773 210/150
D665,047 S * 8/2012 Hoefken ..... B01F 7/00541 D23/207
8,434,744 B2 * 5/2013 Hoefken ..... B01F 3/04531 261/93
8,459,863 B2 * 6/2013 Hoefken ..... B01F 3/04539 366/331
8,651,732 B2 * 2/2014 Hoefken ..... B01F 3/04531 366/295
9,050,567 B2 * 6/2015 Hoefken ..... B01F 7/00541
D733,839 S * 7/2015 Hoefken ..... D23/200
D735,291 S * 7/2015 Hoefken ..... D23/200
10,058,832 B2 * 8/2018 Hoefken ..... B01F 7/0055
2005/0161838 A1 * 7/2005 Hofken ..... B01F 3/04531 261/93
2009/0127213 A1 * 5/2009 Hoefken ..... B01F 3/04773 210/800
2010/0182869 A1 * 7/2010 Hoefken ..... B01F 3/04531 366/343
2010/0196165 A1 * 8/2010 Hoefken ..... B01F 3/04531 416/223 R
2010/0201008 A1 * 8/2010 Hoefken ..... B01F 3/04531 261/93
2011/0003646 A1 * 1/2011 Hoefken ..... B01F 3/04539 464/178
2012/0307587 A1 * 12/2012 Hoefken ..... B01F 7/00541 366/331
2016/0339401 A1 * 11/2016 Hoefken ..... B01F 7/0055
2017/0001156 A1 * 1/2017 Hoefken ..... B01F 7/00541
2017/0021313 A1 * 1/2017 Hoefken ..... B01F 7/00541
2017/0065945 A1 * 3/2017 Hoefken ..... B01F 7/00541

FOREIGN PATENT DOCUMENTS

DE 9106639 U1 * 9/1991 ..... B01F 3/04531
DE 4218027 A1 * 12/1992 ..... B01F 3/04531
DE 4218027 A1 12/1992
DE 29803497 U1 6/1999
WO 2006/108538 A1 10/2006

OTHER PUBLICATIONS

PCT/ISA/237, "Written Opinion of the International Searching Authority for International Application No. PCT/EP2014/072936," dated Jan. 2015.
Hoefken, M. et al., "Ruehr- und Begasungssysteme fuer die effektive Abwasserbehandlung," p. 91-95, vol. 2, Brauindustrie, Retrieved from the Internet: URL: http://fzarchiv.sachon.de/index.php?pdf=Fachzeitschriften/Getraenke-Fachzeitschriften/Brauindustrie/1998/02_98/Bi_02-98_Ruehr-_und_Begasungssysteme_fuer_Abwasserbehandlung.pdf [Retrieved on Sep. 17, 2008].
PCT/ISA/237 "Written Opinion of the International Searching Authority for International Application No. PCT/EP2014/072936," dated Jan. 27, 2015.

* cited by examiner

STIRRING ELEMENT HAVING SEGMENTED CONFIGURATION, FOR CIRCULATING WASTEWATER IN BASIN, AND APPARATUS

RELATED APPLICATIONS

The present application is National Phase of International Application No. PCT/EP2014/072936 filed Oct. 27, 2014, and claims priority from German Application No. 10 2013 225 662.0, filed Dec. 11, 2013, the disclosure of which is hereby incorporated by reference herein in its entirety.

BACKGROUND OF THE INVENTION

The invention relates to a stirring body.

A device in which the stirring body is produced from a piece made of fibre-reinforced plastic is known from DE 42 18 027 A1. The known stirring body is produced manually. It requires the provision of a costly mould.

The object of the invention is to overcome the disadvantages according to the prior art. In particular, a stirring body and also a device that can be produced as easily and economically as possible will be specified.

This object is achieved by the features of the expedient embodiments of the invention will.

SUMMARY OF THE INVENTION

In accordance with the invention it is proposed for the stirring body to be formed from a plurality of segments, which are produced from metal and which are assembled along joining zones extending from the stirring shaft to a peripheral edge of the stirring body. Because the segments forming the stirring body are produced from metal, there is no need to provide a mould, which is associated with a high cost expenditure. The segments can be produced by machine. They can be interconnected once at the place of use. The transport volume is significantly reduced compared with conventional stirring bodies. Due to the proposed profile of the joining zones from the connector piece to the peripheral edge of the stirring body, it is advantageously possible to form the segments so as to be structurally identical. The proposed device can be produced and transported easily and economically.

The joining zones extend from a virtual centerpoint of a circle, of which the periphery corresponds to the periphery of the stirring body. They extend from the centerpoint in the direction of the peripheral edge of the stirring body. The joining zones can be straight or curved in a plan view of the stirring body. They can also be angled and/or can have a number of displacements in the peripheral direction.

In accordance with an advantageous embodiment, the joining zones extend at least in part parallel and/or in a slanting manner relative to a radial direction. In particular, it can be that the joining zones in plan view are formed from a plurality of straight portions, which are interconnected via an angled deflection. Here, an angle $\alpha$ enclosed by adjacent portions can be 130° to 170°. In this case an approximately "curved" joining zone is provided. A joining zone of this type can be used advantageously at the same time for the production of accordingly "curved" transport ribs.

In accordance with a further embodiment each segment has bending lines extending in the radial direction. The conical or hyperboloid-like form of the stirring body is provided by a bending of the segments along the bending lines.

The segments are advantageously produced from a sheet metal produced from high-grade steel having a thickness from 0.5 to 15 mm, preferably 0.8 to 3 mm. High-grade steel sheet is robust and durable. It can be shaped by machine, in particular also in an automated manner.

The segments in plan view expediently have a form similar to a segment of a circle. Here, the approximately radially extending edges of the segments can each be curved in the same direction. The segments are advantageously structurally identical. This saves production costs and facilitates the connection of the segments.

In accordance with a further embodiment shearing ribs are mounted on a peripheral edge portion of the segments forming a portion of the peripheral edge.

The stirring body can in this case also be used to aerate and/or introduce gas into the liquid. The shearing ribs break up large gas bubbles into a multiplicity of small gas bubbles and therefore increase the interface between gas and liquid. This in turn increases the efficiency of the purification.

At least one transport rib can extend from an upper side of each segment facing towards the stirring shaft. The transport ribs improve the stirring efficiency.

In accordance with an advantageous embodiment the joining zones are formed by sheet metal portions bent towards the upper side of the segments. The rigidity of the segments can thus be improved and at the same time a joining and functional surface can be provided: the sheet metal portions, bent for example through 90°, of two adjacent segments can advantageously form a transport rib in the connected state.

The shearing and/or transport ribs are expediently also formed from a sheet metal produced from high-grade steel and are connected to the respective segments by means of at least one spot joint. The spot joints are expediently embodied as rivet joints, screw rivet joints, screw joints or spot-welding joints.

In accordance with a further embodiment a radially inner end of each segment has an angled connector portion provided with an aperture. If all segments are interconnected, the apertures of the connector portions expediently lie on a virtual circle. The connector portions form the connector piece of the stirring body. This enables an attachment of the stirring body to a conventional fitting flange of a stirring shaft.

Each segment is advantageously formed from a plurality of sub-segments, which are assembled along further joining zones extending approximately concentrically relative to the stirring shaft. Sub-segments of this type can be produced relatively easily by means of laser cutting and bending.

The segments and/or the sub-segments are advantageously interconnected by means of fastening means, such as rivets, screw rivets, screws, or by means of spot-welding joints. Joints of this type are permanent. The stirring body according to the invention has outstanding rigidity and durability.

In accordance with a further provision of the invention, a device for circulating wastewater received in a tank is provided, wherein a stirring body according to the invention is mounted on a stirring shaft extending from a drive arrangement. The stirring body is expediently mounted via its connector piece on a flange provided terminally on the stirring shaft.

DESCRIPTION OF THE PREFERRED EMBODIMENT

Figure 1:
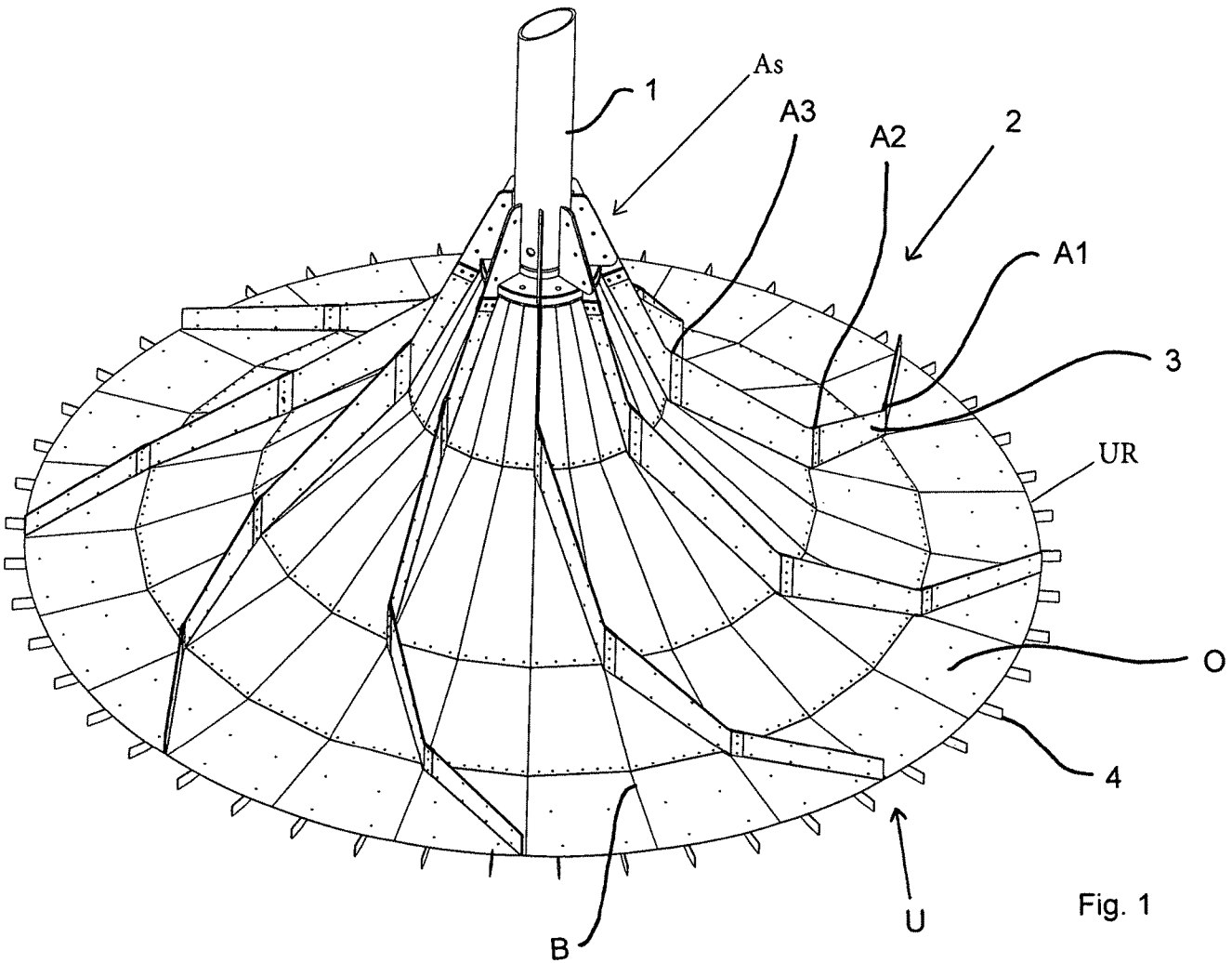
FIG. 1 shows a perspective view of a first stirring body.
Figure 2:
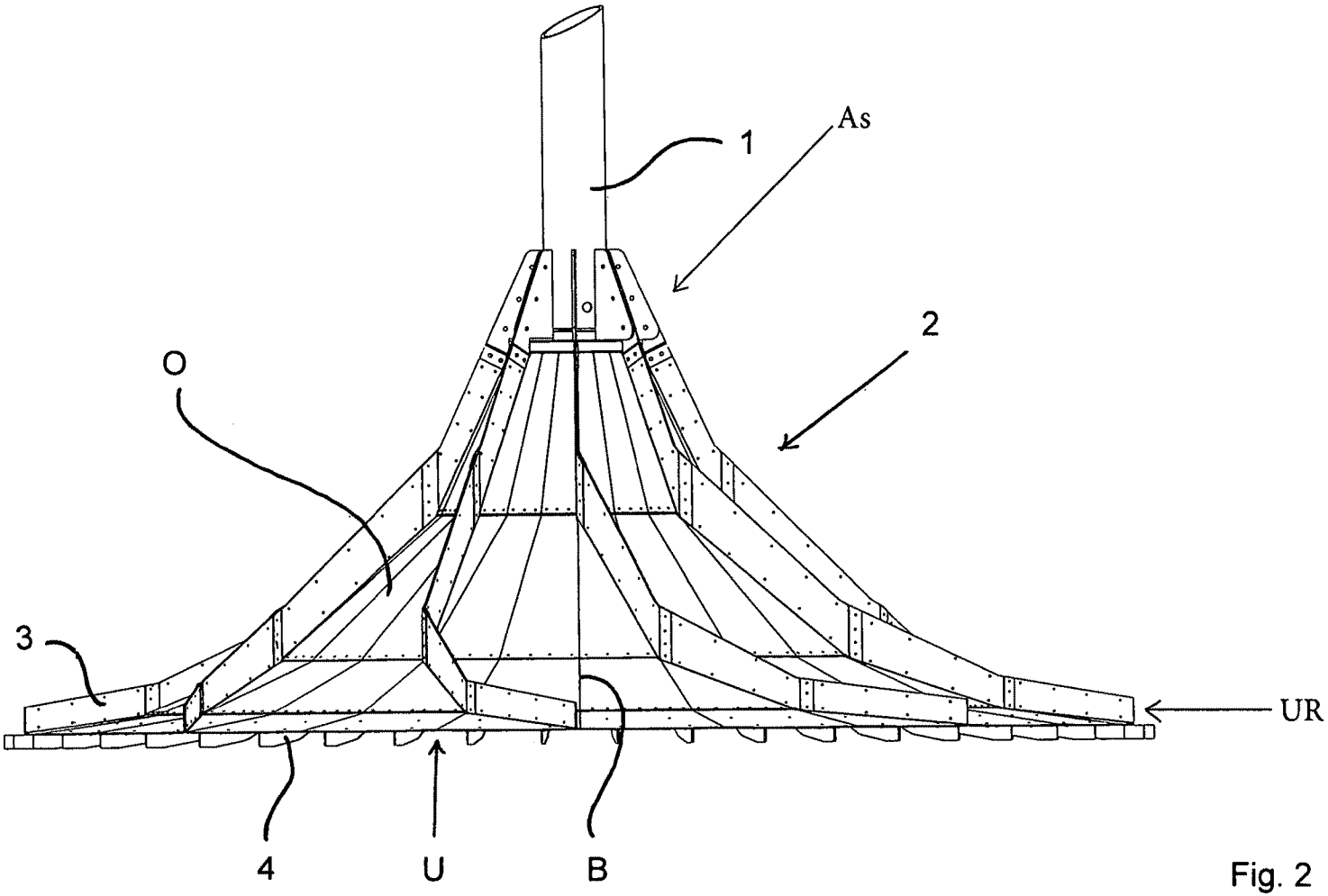
FIG. 2 shows a side view according to FIG. 1.
Figure 3:
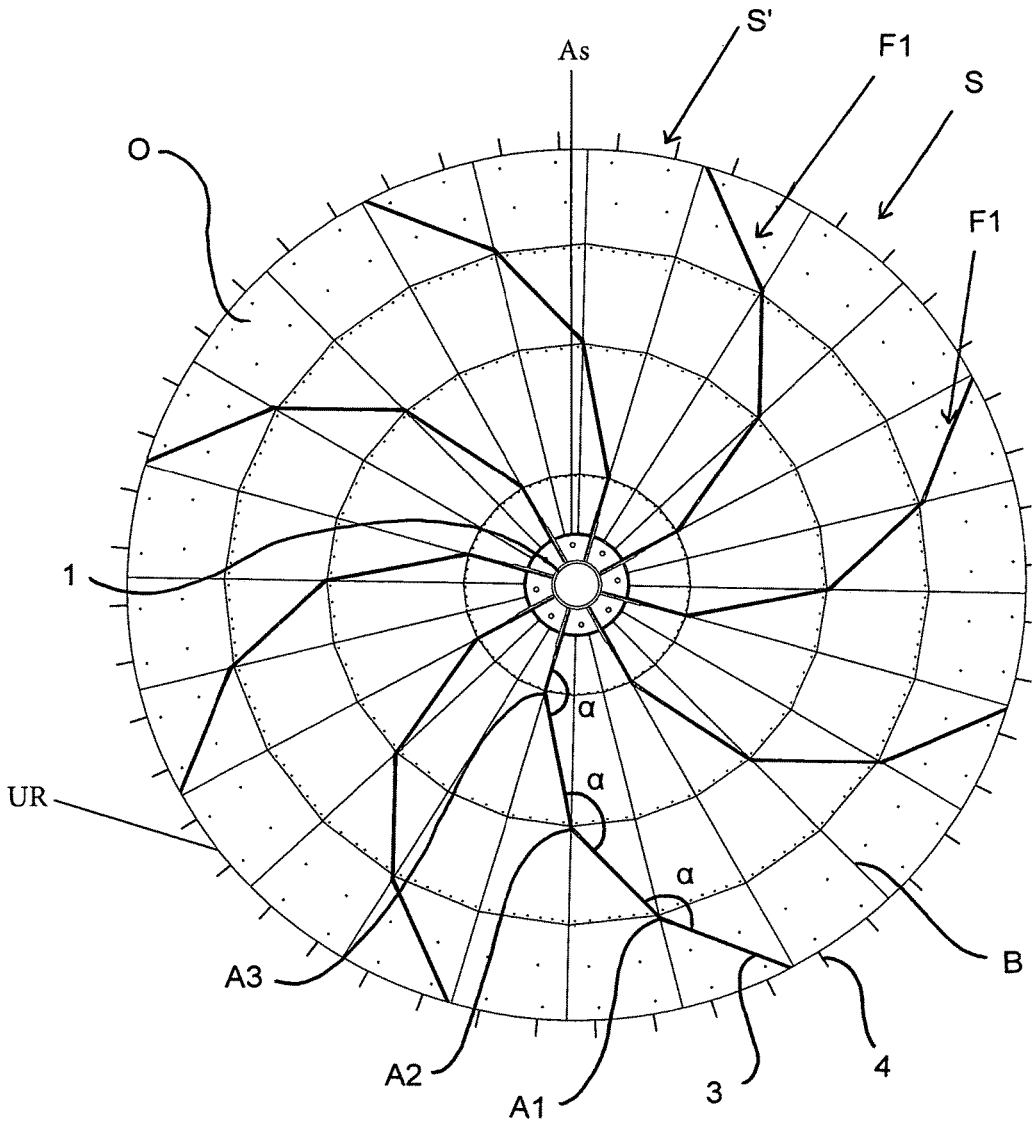
FIG. 3 shows a plan view according to FIG. 1.

Exemplary embodiments of the invention will be explained in greater details hereinafter on the basis of the drawings. In the figures a stirring body denoted generally by the reference sign 2 is mounted on a free end of a vertical stirring shaft 1 extending from a motor (not shown here). The stirring body 2 has a hyperboloid-like shape. A diameter of the stirring body is at least 120 cm, preferably at least 140 to 150 cm. A connector piece As arranged centrally with respect to a peripheral edge UR is connected to the stirring shaft 1. The shape of the stirring body 2 is provided in particular by making bends along radial bending edges B. A plurality of transport ribs 3 are mounted on an upper side O facing towards the stirring shaft 1. The transport ribs 3 have a plurality of angled deflections A1, A2, A3, in each case about an angle α from approximately 145° to 155°. Substantially radially extending shearing ribs 4 are mounted on a radially outer peripheral edge portion of the first stirring body 2 on the underside U thereof, which is opposite the upper side O.

Figure 5:
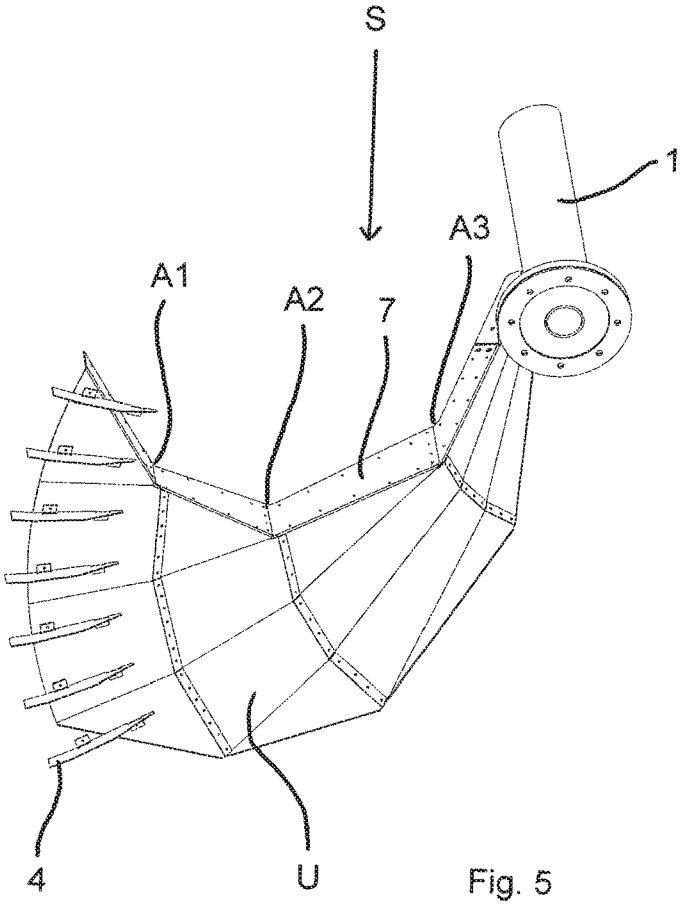
FIG. 5 shows a perspective second view of the segment according to FIG. 4.
Figure 4:
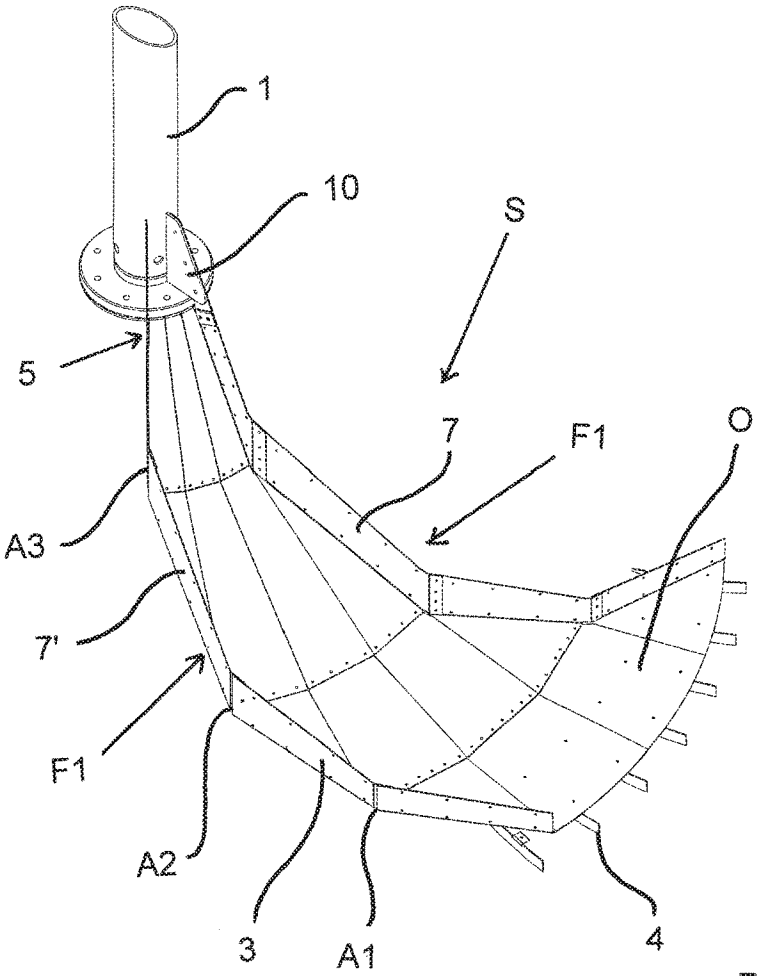
FIG. 4 shows a perspective first view of a segment.
Figure 6:
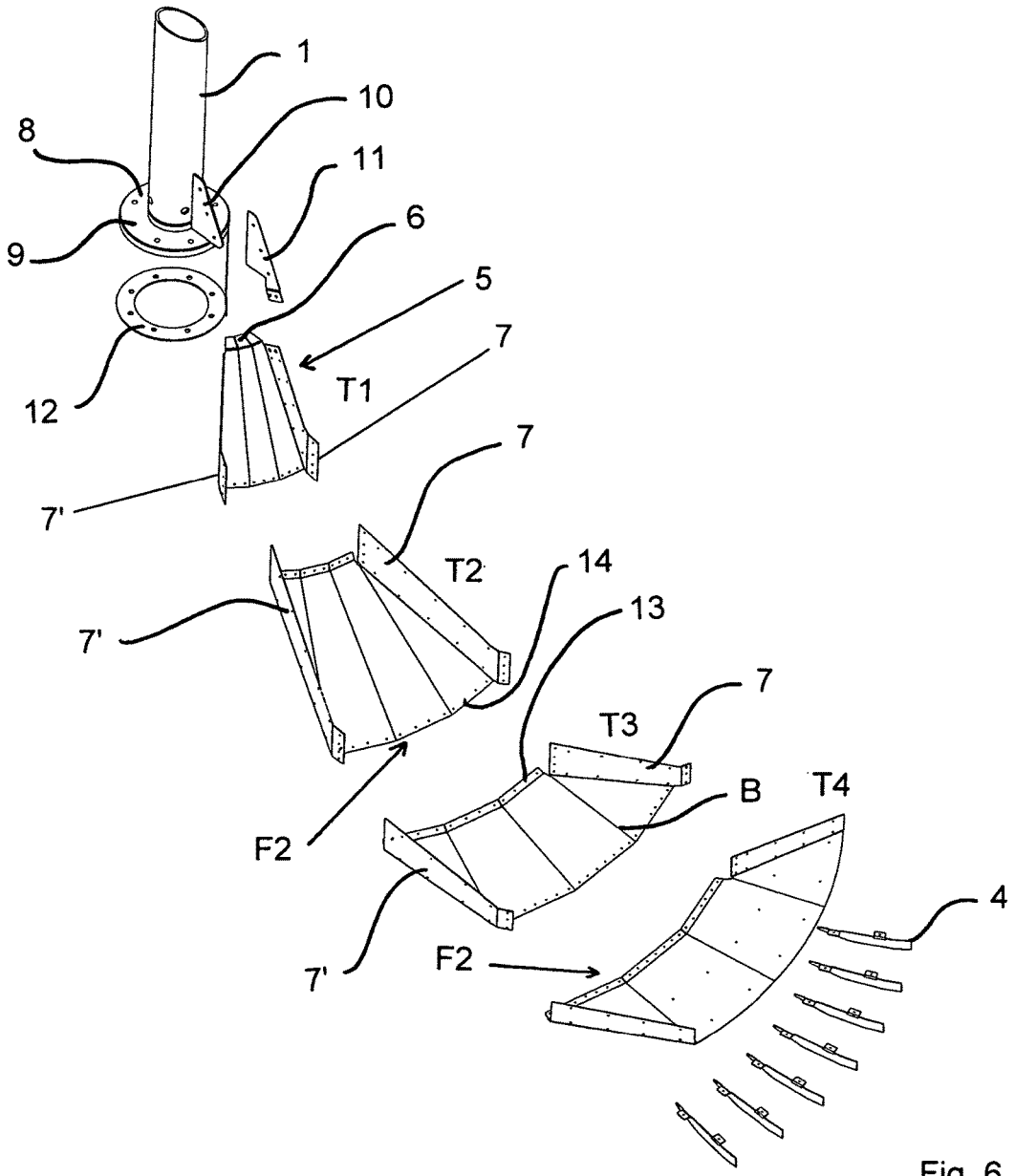
FIG. 6 shows an exploded view of the segment according to FIG. 4.

The stirring body 2 is assembled from a plurality of structurally identical segments S, S'. The segments S, S' are interconnected along joining zones F1. A segment S is shown in FIGS. 4 to 6. The segment S has, at its radially inner end, an angled connector portion 5, which is provided with an aperture 6. The segment S formed similarly to a segment of a circle in plan view has, at its radial edges extending in the radial direction or at an incline thereto, webs 7 angled by approximately 90° in the direction of the upper side O, which are produced by bending or folding. The webs 7 serve as joining surfaces for connection of the segment S to an adjacent segment (not shown here). The connection can be made for example by means of riveting or spot welding. The webs 7, 7' of two interconnected segments S form the transport ribs 3.

A fitting flange 8 is mounted on the free end of the stirring shaft 1 and has a multiplicity of further apertures 9 on a virtual circle. Each of the further apertures 9 corresponds to an aperture 6 of the connector portion 5 of a segment S. Consequently, each segment S can be connected to the fitting flange 8 by means of a screw connection. As can be seen in particular from FIG. 4, the connector portions 5 bear against an underside of the fitting flange 8, such that the apertures 6 are aligned with the further apertures 9. On an opposite, upper side of the fitting flange 8, connector ribs 10 are provided, which are connected via connector pieces 11 to the web 7 of the connector piece 5. Reference sign 12 denotes a perforated ring disc, which is formed correspondingly to the fitting flange 8. The connector portions 5, for fastening to the fitting flange 8, can be fastened in a force-fit manner by means of bolts between the fitting flange 8 and the ring disc 12.

FIG. 6 shows an exploded view of a segment S. The segment S is formed from a plurality of sub-segments T1, T2, T3 and T4. The radial edges of each sub-segment T1, T2, T3, T4 each have a portion of the web 7, 7'. Each sub-segment T1, T2, T3 and T4 also has a further joining zone F2 extending approximately concentrically relative to the stirring shaft 1, said further joining zones being formed by connection tabs 13 and corresponding rows of holes 14 on the adjacent sub-segment T1, T2, T3 and T4. Each of the sub-segments T1, T2, T3, T4 is formed similarly to a U-profile. As a result of the connection of the webs 7, 7' of adjacent sub-segments and also the connection along the further joining zone F2, a segment similar to a segment of a circle is formed, having radial edges deflected by the angle α. The segment S is characterised by outstanding stability and torsional rigidity.

The stirring body 2 is formed from segments S, which are in turn formed from a high-grade steel sheet having a thickness for example from 1.0 to 2.0 mm. The webs 7, 7' are each expediently produced by making bends. They are advantageously interconnected by means of a multiplicity of rivet joints arranged along the direction of extension of the webs 7, 7' (not shown here). The shearing ribs 4 are mounted on the segments S by means of spot welding or further rivet joints. Instead of the rivet joints, screw rivet joints or screwed joints can also be used.

The stirring body is rotationally symmetrical. The symmetry thereof is defined in the present exemplary embodiment by an 8-fold axis of rotation. The axis of rotation corresponds to the number of structurally identical segments. Of course, the stirring body can also be provided in a symmetry with an n-fold axis of rotation, wherein n is advantageously an integer in the range between 6 and 12.

Although in the present exemplary embodiment a stirring body 2 having a hyperboloid-like form is shown, the stirring body can of course also have a different form. For example, it can be conical or can be formed in the shape of a truncated cone. The transport ribs 3 can also extend in a straight line in the radial direction. They can be formed as shown in the explained exemplary embodiment also in the case of the conical or truncated cone-shaped embodiment of the stirring body 2.

LIST OF REFERENCE SIGNS

1 stirring shaft
2 stirring body
3, 3' transport rib
4 shearing rib
5 connector portion
6 aperture
7, 7' web
8 fitting flange
9 further aperture
10 connector rib
11 connector piece
12 ring disc
A1, A2, A3 angled deflection
As connector piece
B radial bending edge
α angle
O upper side
S, S' segment
U underside
UR peripheral edge
F1 joining zone
F2 further joining zone
T1, T2, T3, T4 sub-segment

The invention claimed is:

1. A stirring body for circulating wastewater received in a tank, wherein the stirring body has a conical or hyperboloid shape and a central connector piece for connection to a stirring shaft, the stirring body is formed from a plurality of segments, which is produced from metal and which is assembled along joining zones extending from the stirring shaft to a peripheral edge of the stirring body, and bent sheet metal portions of two adjacent segments form a transport rib in a connected state.

2. The stirring body according to claim 1, wherein the joining zones extend at least in part parallel or in a slanting manner relative to a radial direction.

3. The stirring body according to claim 1, wherein the joining zones are formed from a plurality of straight portions, each of the plurality of straight portions being interconnected to adjacent straight portion via an angled deflection.

4. The stirring body according to claim 3, wherein an angle enclosed by the straight portions adjacent to each other is 130° to 165°.

5. The stirring body according to claim 1, wherein the segments are produced from a sheet metal produced from high-grade steel having a thickness from 0.5 to 15 mm.

6. The stirring body according to claim 1, wherein the segments have a form similar to a segment of a circle in a plan view.

7. The stirring body according to claim 1, wherein the segments are structurally identical.

8. The stirring body according to claim 1, further comprising shearing ribs mounted on a peripheral edge portion of the segments forming a portion of the peripheral edge.

9. The stirring body according to claim 1, wherein the transport rib extends from an upper side of each segment, facing towards the stirring shaft.

10. The stirring body according to claim 1, wherein a radially inner end of each segment has an angled connector portion provided with an aperture.

11. A device for circulating wastewater received in a tank, wherein the stirring body according to claim 1 is mounted on the stirring shaft extending from a drive arrangement.

12. A stirring body for circulating wastewater received in a tank, wherein the stirring body has a conical or hyperboloid shape and a central connector piece for connection to a stirring shaft, the stirring body is formed from a plurality of segments, which is produced from metal and which is assembled along joining zones extending from the stirring shaft to a peripheral edge of the stirring body, and each segment has bending lines extending in the radial direction.

13. A stirring body for circulating wastewater received in a tank, wherein the stirring body has a conical or hyperboloid shape and a central connector piece for connection to a stirring shaft, the stirring body is formed from a plurality of segments, which is produced from metal and which is assembled along joining zones extending from the stirring shaft to a peripheral edge of the stirring body, and the joining zones are formed by sheet metal portions bent towards an upper side of the segments.

14. A stirring body for circulating wastewater received in a tank, wherein the stirring body has a conical or hyperboloid shape and a central connector piece for connection to a stirring shaft, the stirring body is formed from a plurality of segments, which is produced from metal and which is assembled along joining zones extending from the stirring shaft to a peripheral edge of the stirring body, and shearing ribs and/or transport ribs are formed from a sheet metal produced from high-grade steel and are connected to the respective segments by at least one spot joint.

15. A stirring body for circulating wastewater received in a tank, wherein the stirring body has a conical or hyperboloid shape and a central connector piece for connection to a stirring shaft, the stirring body is formed from a plurality of segments, which is produced from metal and which is assembled along joining zones extending from the stirring shaft to a peripheral edge of the stirring body, and each segment is formed from a plurality of sub-segments, which is assembled along further joining zones extending approximately concentrically relative to the stirring shaft.

16. The stirring body according to claim 15, wherein the segments or the sub-segments are interconnected by rivet or spot-welding joints.

* * * * *